US005253703A

United States Patent [19]

Master et al.

[11] Patent Number: 5,253,703

[45] Date of Patent: Oct. 19, 1993

[54] WASTE HEAT EXCHANGER

[75] Inventors: Bashir I. Master, Wayne; Philip A. Weiner, Succasunna, both of N.J.

[73] Assignee: ABB Lummus Crest Inc., Bloomfield, N.J.

[21] Appl. No.: 938,831

[22] Filed: Sep. 1, 1992

[51] Int. Cl.[5] ..... F22B 21/22

[52] U.S. Cl. ..... 165/82; 165/163; 165/83; 122/235.15; 122/235.21; 122/332; 122/244; 122/281; 122/510

[58] Field of Search ..... 122/244, 281, 321, 332, 122/333, 335, 132, 185, 245, 246, 235.19, 235.21, 510; 165/163, 82, 83

[56] References Cited

U.S. PATENT DOCUMENTS 832,572 10/1906 Flamm et al. ..... 122/244

3,172,739 3/1965 Koniewiez ..... 122/510

FOREIGN PATENT DOCUMENTS 101486 7/1937 Australia ..... 122/281

*Primary Examiner*—Albert W. Davis, Jr.

*Attorney, Agent, or Firm*—Chilton, Alix & Van Kirk

[57] ABSTRACT

A heat exchanger adapted to handle dusty hot waste gases including a vertically oriented shell through which the waste gases flow longitudinally downward. The shell contains a tube assembly of vertical tubes having external, longitudinal heat transfer fins with the tubes being connected for fluid flow and support of their upper and lower ends to a central vertical support/header assembly. This support/header assembly is a tube divided into an upper header, a lower header and a center support tube section.

3 Claims, 4 Drawing Sheets

WASTE HEAT EXCHANGER

BACKGROUND OF THE INVENTION

The present invention relates to a waste heat exchanger and has particular applicability to such heat exchangers used for dusty hot waste gases.

In dusty hot waste gas service, conventional waste heat exchanger designs of the shell-and-tube type have the hot waste gases going through the tubes and the fluid on the shell side. These heat exchangers use typical horizontal tube sheets with vertical tubes and they are susceptible to large quantities of dust buildup on the inlet or upper tube sheet and erosion inside the tubes. Expensive dust separation equipment is often required in order to provide trouble-free operation.

SUMMARY OF THE INVENTION

This invention is a heat exchanger particularly adapted to handle dusty hot waste gases and is of the general shell and tube type. The object is to provide a design which will not allow the build-up of dust that could significantly reduce performance. Specifically, the exchanger includes a vertically oriented shell through which the waste gases flow longitudinally with the shell containing a tube assembly of vertical tubes having external, longitudinally extending heat transfer fins. These tubes are connected for fluid flow and supported at their top and bottom ends to a central vertical support header system.

DESCRIPTION OF THE PREFERRED EMBODIMENTS

Figure 1:
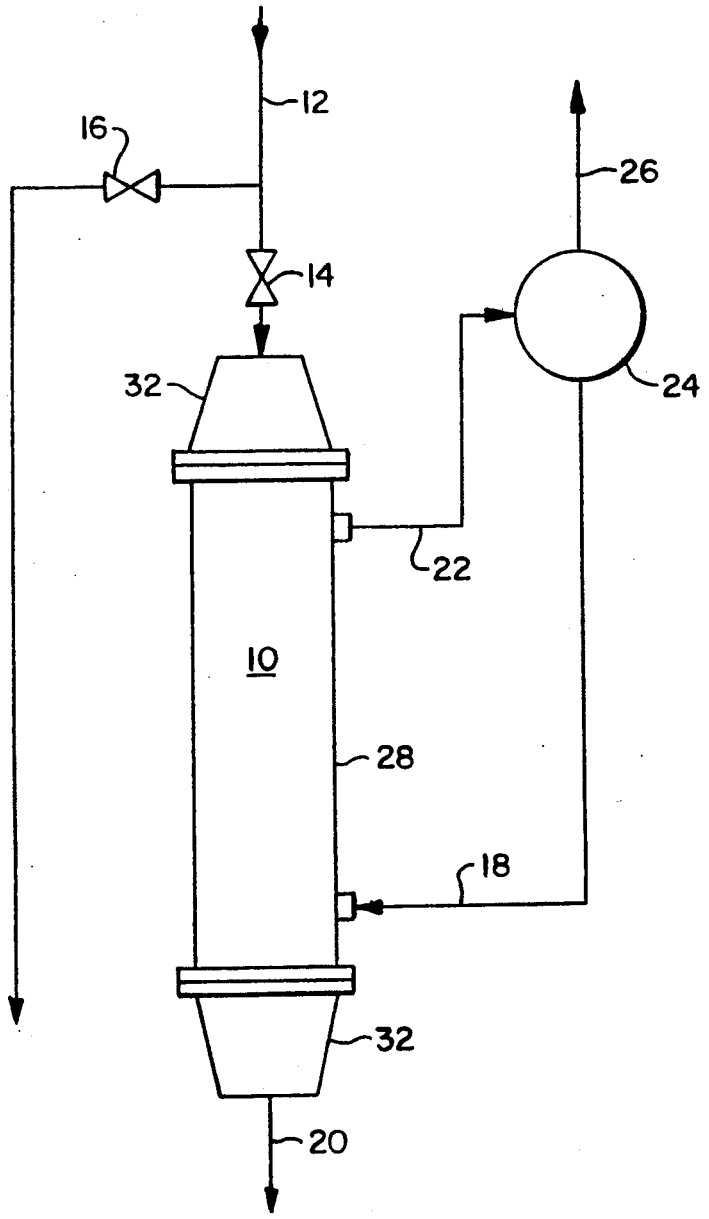
FIG. 1 illustrates the general arrangement and configuration of the heat exchanger of the present invention.

FIG. 1 illustrates the heat exchanger 10 of the present invention in a system for recovering heat from a hot, dusty waste gas stream 12 such as from a coal gasification plant. Merely for purposes of illustration, a bypass system including the valves 14 and 16 are included. The waste gas stream 12 is fed through the heat exchanger 10 wherein the heat is transferred to the fluid entering the heat exchanger through line 18. The cool gases are discharged from the heat exchanger 10 through line 20 while the heated fluid is discharged through line 22. In this example, the entering fluid in line 18 is water and the heated fluid is a mixture of water and steam which are fed to the steam drum 24 where the steam is separated and discharged through line 26. The separated water is then returned to the heat exchanger 10 through the line 18.

Figure 2:
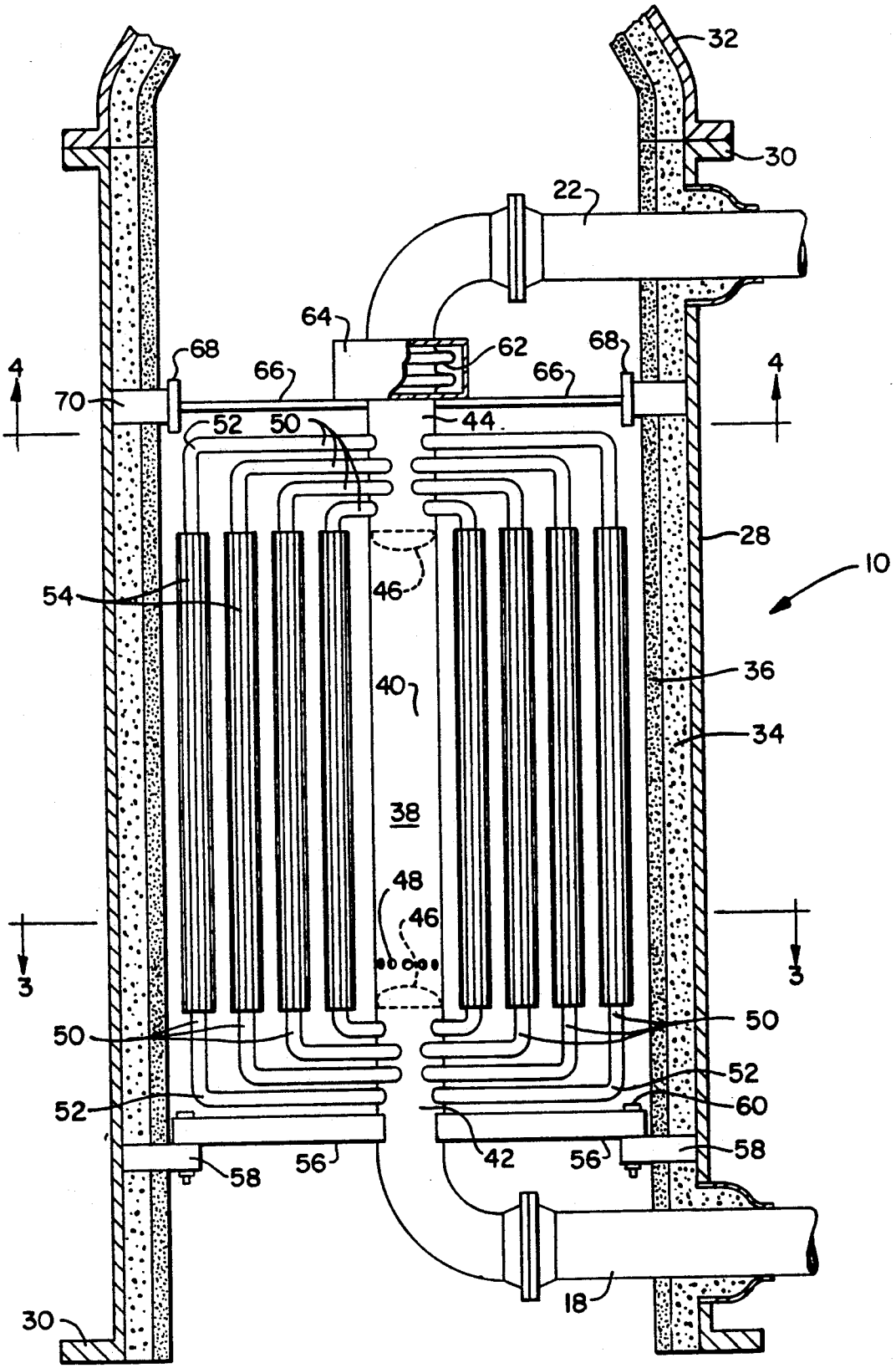
FIG. 2 is a vertical cross-sectional view of the heat exchanger of the present invention.

Referring now to FIG. 2, the heat exchanger 10 comprises a shell 28 including the flanges 30 for the purpose of attaching the end fittings 32 as shown in FIG. 1. The end fittings 32 have suitable means for attaching the inlet and outlet gas ducts. The shell 28 is lined with an insulating and erosion resistant material. In the preferred embodiment shown, the lining layer 34 is an insulating castable refractory material while the layer 36 is an erosion resistant refractory material.

Mounted in the center of the heat exchanger 10 within the shell 28 is the support/header assembly 38. The support/header assembly comprises the central support tube 40 which is integral with the lower inlet header 42 and the upper outlet header 44. The support tube section 40 is partitioned from the lower and upper headers by means of the end caps 46 which are dome-shaped pieces welded inside the support tube 40 to prevent flow through the support tube 40 from the lower inlet header 42 to the upper outlet header 44. Also included in the support tube 40 are the vent hole 48 which accommodate pressure variations and balance the pressure inside and outside of the support tube 40. The support tube 40 connecting the headers 42 and 44 fills in the central portion of the heat exchanger which is an area that is ineffective for heat transfer. This increases the gas velocity past the tubes thus increasing the heat transfer coefficient.

Figure 3:
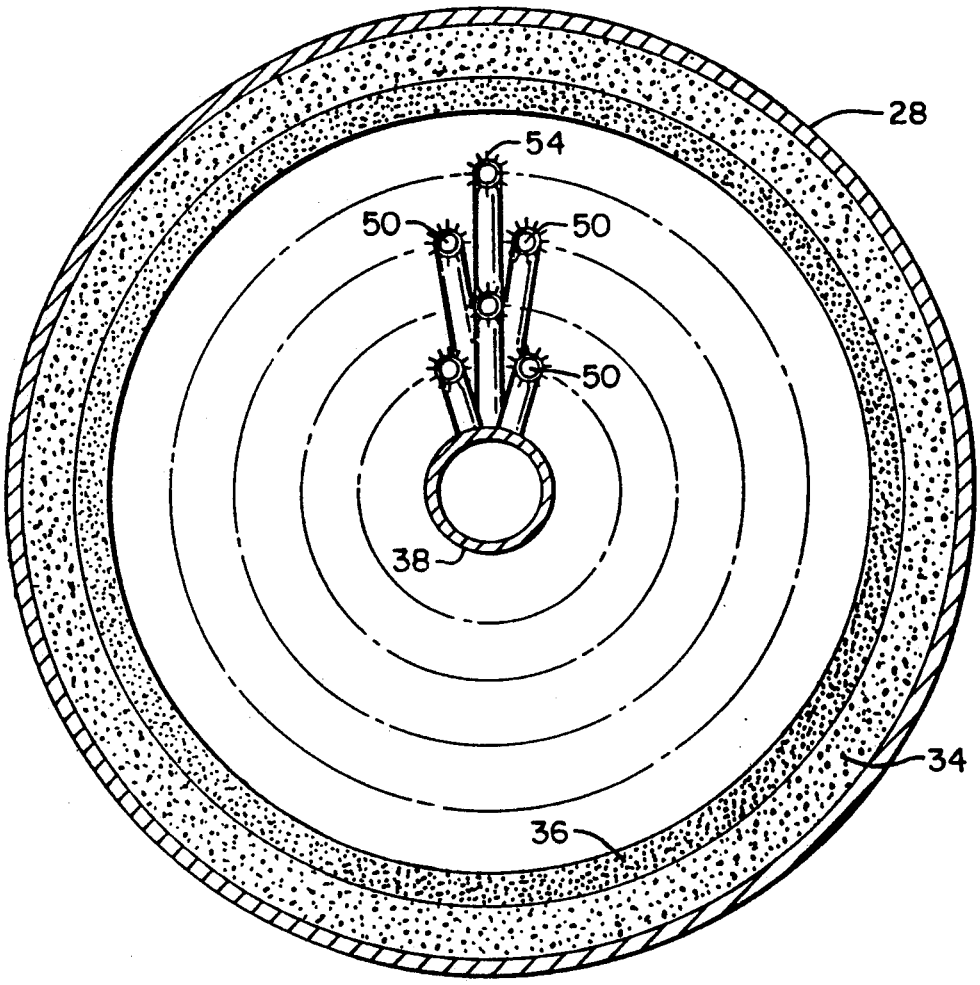
FIG. 3 is a cross-sectional view taken along line 3—3 of FIG. 2.

The tube assembly of the heat exchanger 10 comprises a plurality of vertical tubes 50 having bends 52 at their upper and lower ends with these tubes then being radially attached to the inlet header 42 and the outlet header 44. The vertical tubes 50 are arranged in a concentric ring pattern as shown in FIG. 3. The tubes incorporate longitudinal fins 54 on the vertical portion of the tubes. These fins form extended heat transfer surfaces thus reducing the number of tubes that would be required if bare tubes were used. Since gas flow is downward along the longitudinal fins, they do not present a horizontal surface on which the dust particles could accumulate. Also, the horizontal radially extending portions of the tubes 50 which are connected to the headers 42 and 44 are circular in cross section and do not present any significant surface on which dust could accumulate. Furthermore, the gas flowing down through the heat exchanger tends to flush any dust particles out of the heat exchanger.

The support/header assembly 38 is supported in the heat exchanger 10 by means of the beams 56 which are welded to the support/header assembly 38 and which extend outwardly and rest on the ledges 58. These ledges 58 are welded to the shell 28. Bolts 60 hold the support beams 56 in place on the ledges 58. If it is necessary, stiffeners (not shown) can be welded to the external surface of the support tube 40 for additional strength.

The design of the tube assembly and the support/-header assembly 38 also provides for thermal expansion. The tube bends 52 at both the upper and lower end of the tube bundle accommodate the differential temperature and therefore the differential thermal expansion between the tubes 50 and the center support/header assembly 38. The differential expansion between the center support/header assembly 38 and the shell 28 is accommodated by an expansion joint 62 covered by the protective shroud 64.

Figure 4:
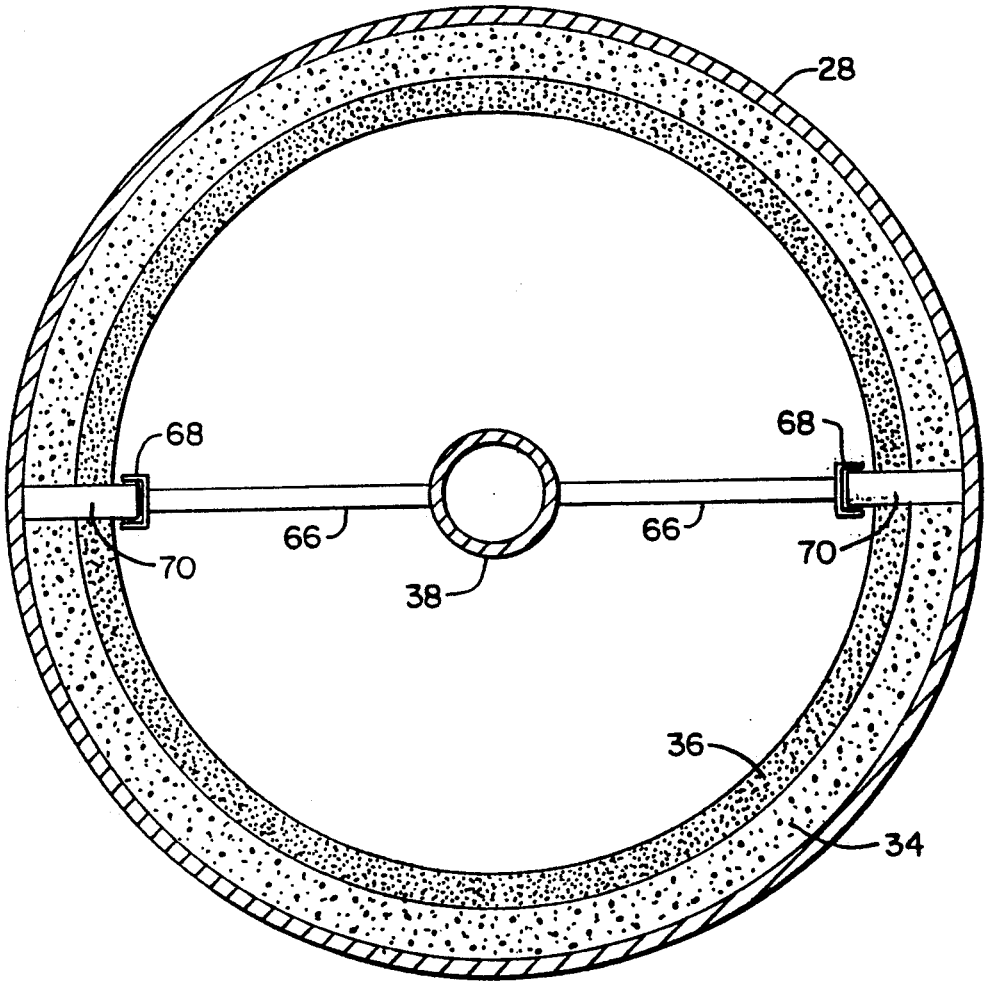
FIG. 4 is a cross-sectional view of the upper guide structure taken along line 4—4 of FIG. 2.

The support system also includes provisions to guide the upper portion of the tube assembly as it grows from the bottom support. This guide includes the guide bars 66 which are welded to the support/header assembly 38. These guide bars terminate in the channels 68 which are welded to the guide bars 66 as best seen in FIG. 4. These channels 68 slide up and down on the bars 70 which are welded to the shell 28 to accommodate any differential thermal expansion between the support/-header assembly 38 and the shell 28. This guide arrangement also prevents excessive rotation between the shell and the tube assembly and also minimizes any induced vibration in the tube assembly.

The support of the tube assembly inside the shell need not be at the bottom, inlet header elevation. The tube assembly can be hung off support members located at the top outlet header elevation. If the support is to be at the top, the expansion joint 62 shown on the outlet piping would be moved to the lower inlet piping. Also, if the tube assembly is to be supported from the top, then the guide assembly 66, 68, 70 would be moved to the bottom, inlet header elevation.

In operation, a single phase liquid, for example water from the steam drum 24, flows through the downcomer piping into the inlet piping of the waste heat exchanger 10. The liquid flows into the inlet header 42 and is distributed radially into the multitude of vertical heat exchange tubes 50. The liquid rises through the tubes 50 and is partially vaporized as heat is transferred to the liquid through the tubes from the gas. The flow from each tube 50 then enters the outlet header 44 and is discharged through exit piping 22 to the steam drum 24. The steam drum 24 is located at an elevation above the outlet header 44 in order to achieve the desired circulation through the system. The difference in specific gravity of the partially vaporized fluid in the heat exchanger as compared to that of the water in the downcomer of the steam drum will provide the driving force to circulate the fluid through the system.

We claim:

1. A heat exchanger including a vertically oriented shell having an upper end and a lower end and a longitudinal gas passage therethrough, gas inlet means at the upper end of said shell and gas outlet means at the lower end of said shell whereby gas passes longitudinally down through said shell and comprising:

a. a support/header tube assembly extending longitudinally through said shell generally at the center thereof, b. means dividing said support-header tube assembly into an upper header, a lower header and a middle support tube, c. a plurality of longitudinally extending heat exchange tubes between said shell and said support/-header tube assembly, each tube upper and lower ends bent and extending generally horizontally inward and attached for support and fluid flow to said upper and lower headers respectively, d. means for feeding fluid into said lower header and up through said heat exchange tubes and out through said upper header, and e. means for supporting said support/header tube assembly in said shell, said means for supporting adapted to permit differential thermal expansion between said shell and said support/header tube assembly and comprising beams extending between and attached to said lower header and said shell.

2. A heat exchanger as recited in claim 1 wherein said means for support further includes means for attaching said upper header to said shell so as to permit relative longitudinal movement between said upper header and said shell to accommodate differential thermal expansion.

3. A heat exchanger as recited in claim 1 wherein said middle support tube of said support/header tube assembly includes vent holes for equalizing the pressure inside and outside of said middle support tube.

* * * * *